US011690464B2

(12) United States Patent
Spiro et al.

(10) Patent No.: US 11,690,464 B2
(45) Date of Patent: Jul. 4, 2023

(54) ADJUSTABLE FRAMING SYSTEM

(71) Applicant: Tracer Imaging LLC, Ossining, NY (US)

(72) Inventors: Steven M. Spiro, Chappaqua, NY (US); Ryan Kelly, Scarsdale, NY (US); Ryan Spiro, Chappaqua, NY (US)

(73) Assignee: Tracer Imaging LLC, Ossining, NY (US)

( * ) Notice: Subject to any disclaimer, the term of this patent is extended or adjusted under 35 U.S.C. 154(b) by 0 days.

(21) Appl. No.: 17/492,009

(22) Filed: Oct. 1, 2021

(65) Prior Publication Data

US 2022/0104637 A1 Apr. 7, 2022

Related U.S. Application Data

(60) Provisional application No. 63/086,939, filed on Oct. 2, 2020.

(51) Int. Cl.
*A47G 1/16* (2006.01)
*A47G 1/17* (2006.01)

(52) U.S. Cl.
CPC ..... *A47G 1/166* (2013.01); *A47G 1/1613* (2013.01); *A47G 1/17* (2013.01)

(58) Field of Classification Search
CPC ..... A47G 1/166; A47G 1/1613; A47G 1/17; A47G 1/065
See application file for complete search history.

(56) References Cited

U.S. PATENT DOCUMENTS 4,432,152 A 2/1984 Daenen
4,912,863 A * 4/1990 Harvey ..... A47G 1/065 40/781
9,395,044 B2 * 7/2016 Cheng ..... F16M 13/022
10,307,001 B1 * 6/2019 Fitzpatrick ..... A47G 1/166
2010/0133409 A1 6/2010 Park et al.
2011/0138666 A1 * 6/2011 Borde ..... A47G 1/166 40/747
2015/0272352 A1 * 10/2015 Chowdhury ..... A47G 1/166 248/479
2019/0045948 A1 * 2/2019 Gale ..... A47G 1/1613
2020/0397161 A1 12/2020 Spiro et al.
2022/0031095 A1 2/2022 Spiro et al.

FOREIGN PATENT DOCUMENTS

EP 0087024 A2 8/1984
FR 2704126 A1 * 10/1994 ..... A47G 1/065
WO WO-0134001 A1 * 5/2001 ..... A47G 1/1606

OTHER PUBLICATIONS

International Search Report and Written Opinion in PCT Application No. PCT/US2021/53130, dated Jan. 18, 2022.

* cited by examiner

*Primary Examiner* — Cassandra Davis
(74) *Attorney, Agent, or Firm* — Leason Ellis LLP

(57) ABSTRACT

A frame system includes a mount having an outer surface for receiving an adhesive for placement on a support surface and an inner surface that includes a plurality of first coupling elements. The frame system also includes a hollow outer frame element and a back plate configured for insertion into and attachment to the outer frame element. The back plate includes a plurality of second coupling elements that mate with the first coupling elements for attaching the back plate to the mount in such a way that the back plate can rotate relative to the mount to allow for adjustment of the combined outer frame element and the back plate.

18 Claims, 6 Drawing Sheets

ADJUSTABLE FRAMING SYSTEM

CROSS-REFERENCE TO RELATED PATENT APPLICATIONS

This application is based on and claims priority to U.S. Provisional Patent Application 63/086,939, filed Oct. 2, 2020.

TECHNICAL FIELD

The present disclosure is directed to a frame for displaying an object, such as a photograph or artwork, and more particularly, relates to a framing system (frame) or assembly that includes a rear component for fixed attachment to a support surface and a front component that is adjustable relative to the fixed rear component to allow adjustments to be made to the framing system without removal from the support surface.

BACKGROUND

For hundreds of years it has been customary to display photographs or other artwork on walls enclosed in picture frames. The design of these frames has virtually remained unchanged, consisting of a wooden molding outer frame with enclosed backer board, upon which a photograph is placed covered in part at the edges with a chipboard mat with bevel cut opening, covered by a pane of glass. A wire line draped from edge to edge on the backside of the frame is then used to hang the frames on a nail/hook or screw imbedded into the wall.

Alternative mounting systems have been commercialized including the use of an adhesive as part of the mounting system. However, one of the challenges of using an adhesive is that it can mar the support surface and also, it is difficult if not impossible to make minor adjustments to the frame position on the support surface. If an adhesive bond is broken with the support surface for the purpose of repositioning of the frame, not only can marring of the support surface occur but also once the adhesive bond is broken, it weakens and reapplication to the support surface results in a weaker bond.

There is therefore a need to provide a framing system that is easy to assembly and also allows for repositioning of the framing system on the support surface without suffering from the deficiencies of the existing frame products.

SUMMARY

A frame system includes a mount having an outer surface for receiving an adhesive for placement on a support surface and an inner surface that includes a plurality of first coupling elements. The frame system also includes a hollow outer frame element and a back plate configured for insertion into and attachment to the outer frame element. The back plate includes a plurality of second coupling elements that mate with the first coupling elements for attaching the back plate to the mount in such a way that the back plate can rotate relative to the mount to allow for adjustment of the combined outer frame element and the back plate.

BRIEF DESCRIPTION OF THE DRAWING FIGURES

DETAILED DESCRIPTION OF CERTAIN EMBODIMENTS

Figure 1:
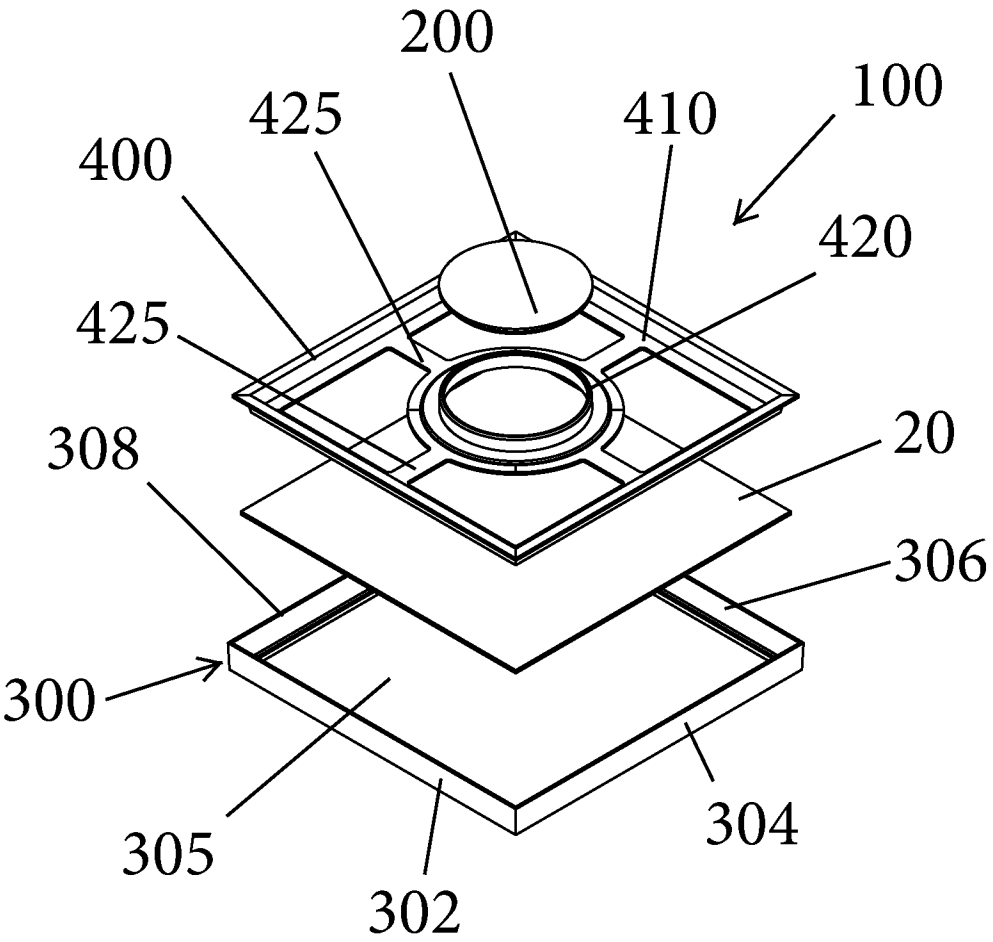
FIG. 1 is an exploded perspective view of an adjustable framing system according to a first embodiment.
Figure 3:
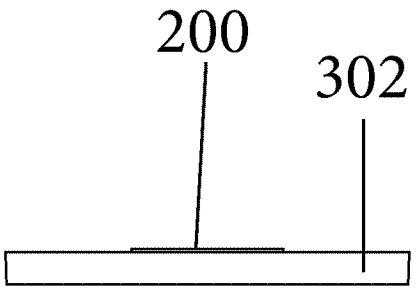
FIG. 3 is a side elevation view thereof.
Figure 2:
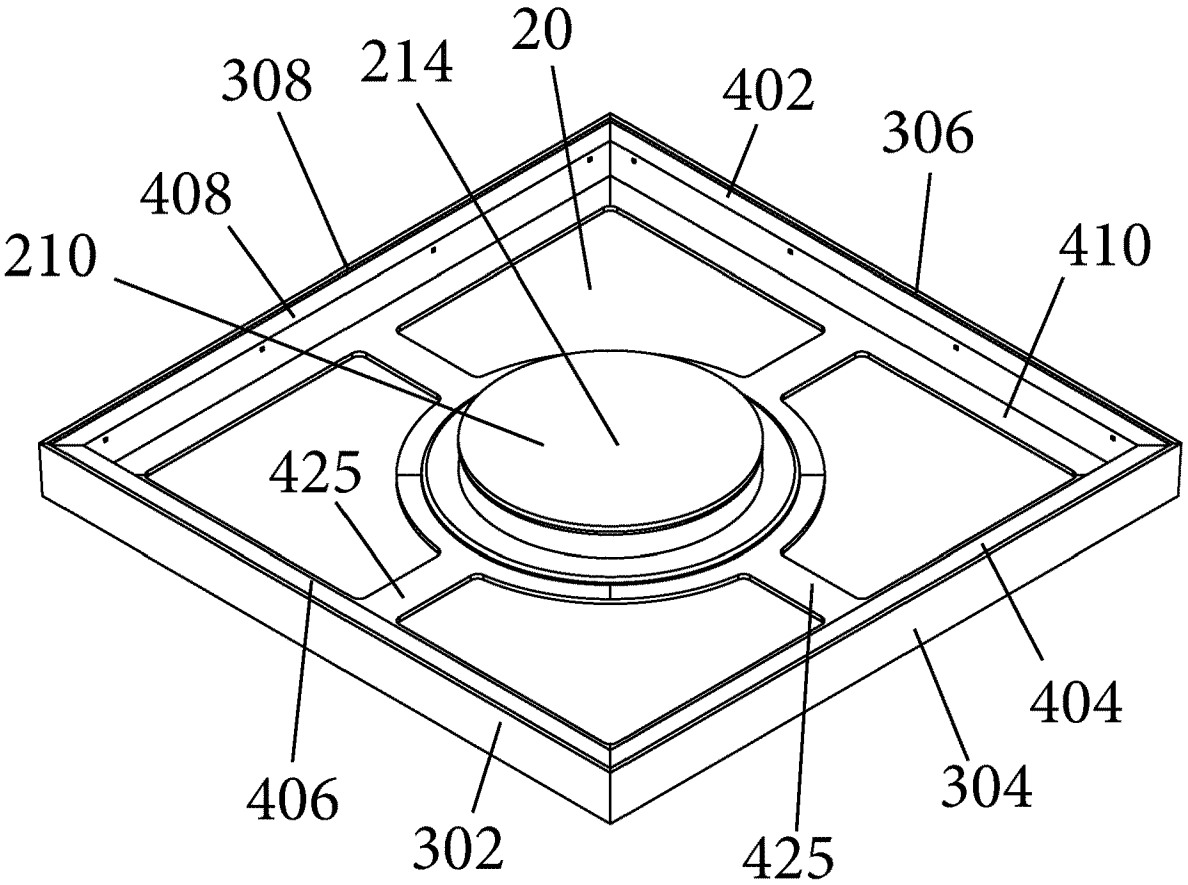
FIG. 2 is rear perspective view of the adjustable framing system.
Figure 5:
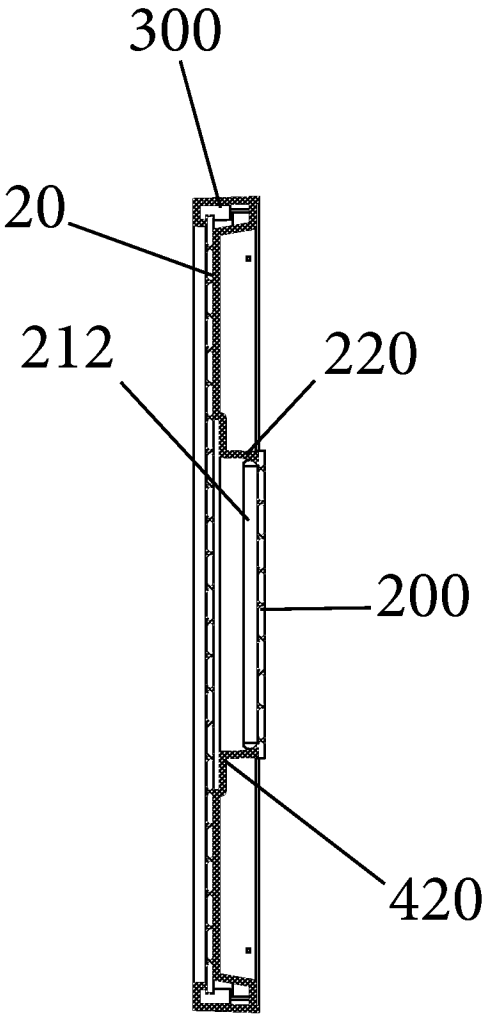
FIG. 5 is a cross-sectional view taken through the line A-A of FIG. 4.
Figure 4:
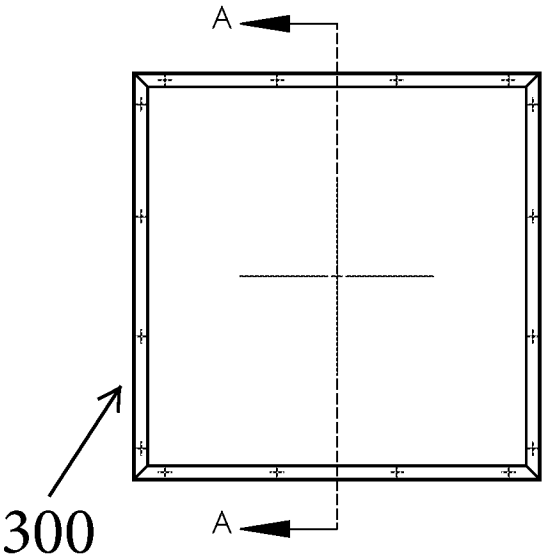
FIG. 4 is a front elevation view thereof.

Adjustable Framing System 100 (FIGS. 1-5) In accordance with the present disclosure, as illustrated in FIGS. 1-5, a framing system or assembly (kit) 100 is shown and described and is configured to create a framed article that can be displayed either on a support surface, such as a wall. The framed article is configured to display an image that is part of an image substrate 20 that is held and displayed within the framing system 100. The image substrate 20 is typically a rigid substrate on which an image is displayed. While the image substrate 20 is illustrated in the figures as a single layer, it will be appreciated that the image substrate 20 can include more than one layer, such as a rigid backing layer and a photo layer or the like. The image displayed can take any number of different forms including a paper clipping, a photo, artwork including a painting on canvas, or other artistic expression.

As described herein, the framing system 100 provides an easy to use and easy to assemble kit that allows a user to assemble the frame and position and retain the image substrate 20 therein.

The framing system 100 has two main parts, namely, a mount 200 that is configured to be fixedly attached to the support surface and a frame subassembly that is formed of an outer frame element 300 and a back plate 400 that mates with the outer frame element 300 to form the assembled frame. As described herein, the outer frame element 300 and the back plate 400 are attached to one another with a mechanical fit and more particularly, can snap-fittingly mate with one another.

Mount 200

The mount 200 is constructed and intended to be fixedly attached to the support surface (wall), while allowing the frame subassembly to be rotatably coupled to the mount 200. As described herein, this arrangement allows for the frame subassembly to be adjusted, in a rotational direction, while the entire framed article is mounted to the support surface. In other words, the framed article does not have to be taken down in order to make (rotational) adjustments.

The mount 200 has a center wall 210 that has an inner surface 212 and an outer surface 214. The mount 200 has an annular shaped wall 220 that extends outwardly from the inner surface 212. The annular shaped wall 220 has a first locking feature that is designed to mate with a complementary second locking feature that is part of the back plate 400. For example, at the free end of the annular shaped wall 220, an outwardly extending lip (male feature) can be provided.

In the illustrated embodiment, the mount 200 has a disk shape and therefore, the center wall 210 has a circular shape. The annular shaped wall 220 has a diameter that is less than a diameter of the center wall 210 and therefor, the annular shaped wall 220 is spaced inwardly from the peripheral edge of the center wall 210.

The outer surface 214 of the center wall 210 includes an adhesive pad (not shown), such as a double-sided adhesive pad that is bonded to the outer surface 214 along an inner surface thereof. The outer surface of the adhesive pad can include a release layer that is removed to reveal an adhesive layer, such as a permanent adhesive layer. The mount 200 is attached to the support surface by pressing the adhesive layer onto the support surface.

Outer Frame Element 300

The outer frame element 300 is a hollow piece that has a main body that defines a hollow center opening 305. The outer frame element 300 can have any number of different shapes and sizes based on the intended shape and size of the framed article. The main body of the outer frame element 300 has a plurality of (e.g., four) interconnected walls 302, 304, 306, 308. The illustrated main body has a square shape and therefore, each of the interconnected walls 302, 304, 306, 308 can be in the form of a rail or the like. Each of the walls 302, 304, 306, 308 has an outer surface and an inner surface. The illustrated outer surface represents the portion of the frame system 100 that is readily visible and therefore, it can be smooth or it can have a decorative finish (and thus is not limited to being a smooth surface).

The outer frame element 300 can be formed of any number of suitable materials including suitable plastics (e.g., injection molded plastics).

Back Plate 400

The back plate 400 serves as the rear part of the frame assembly 100 that is located behind the image substrate 20 and the engagement of the back plate 400 to the outer frame element 300 serves to capture and hold the image substrate 20 between the back plate 400 and the outer frame element 300.

As mentioned, the back plate 400 attaches to the outer frame element 300 and closes off the back of the frame system 100. As also described herein, the image substrate 20 is disposed and held between the back plate 400 and the outer frame element 300 and more particularly, the user places the image substrate onto an inner landing 310 of the outer frame element 300 and then attaches the back plate 400 to the outer frame element 300, thereby and the image substrate 20 therebetween.

As shown, the back plate 400 is inserted into the hollow opening of the outer frame element 300 with locking features of the back plate 400 engaging locking features of the outer frame element 300 to form a snap-fit. One exemplary snap-fit constructions is described in U.S. patent application No. 63/059,249, filed Jul. 31, 2020. The back plate 400 has a complementary shape to the outer frame element 300 and therefore, in the illustrated embodiment, the back plate 400 is square shaped.

As shown, the back plate 400 has a first wall 402, a second wall 404, a third wall 406, and a fourth wall 408 that are all interconnected to one another. Between the first wall 402, the second wall 404, the third wall 406, and the fourth wall 408, an inner wall 410 is provided and extends between these walls. The inner wall 410 has a front face that faces and contacts the image substrate 20 and an opposite rear face of the inner wall 410 faces away from the inner wall 410.

Within the hollow center of the back plate 400, there is an annular shaped wall 420 that is connected to the walls 402, 404, 406, 408. For example, the annular shaped wall 420 can be connected to each side wall 402, 404, 406, 408 by a connecting wall or spoke 425. In the illustrated embodiment, the annular shaped wall 420 has four spokes 425 that connect to the side walls 402, 404, 406, 408. As shown, the annular shaped wall 420 can have a stepped construction from the spokes 425 to the annular shaped wall 420.

The annular shaped wall 420 has a second locking feature that mates with the first locking feature of the mount 200 for establishing a secure connection (e.g., snap-fit) between the mount 200 and back plate 400. For example, the annular shaped wall 420 can include inwardly extending lip that defines an underside space in which the outwardly extending lip at the free end of the annular shaped wall 220 is received. In this arrangement the lip of the annular shaped wall 220 can be considered to be the male part and the space under the lip of the annular shaped wall 420 can be considered to be the female part. However, it will be appreciated that the reverse is also possible in that the annular shaped wall 420 can include a male part, such as a protrusion, that is received within a female part, such as a channel or groove, that is formed within annular shaped wall 220. In this way, a snap-fit can be formed between the mount 200 and the back plate 400 (when the annular shaped walls 220, 420 engage one another).

The back plate 400 can be formed of any number of suitable materials including suitable plastics (e.g., injection molded plastics). As shown, the back plate 400 is preferably an integral single piece structure.

Mounting Process

The mount 200 is designed to snap fit with the back plate 400 while still permitting rotation of the back plate 400

The diameter of the annular shaped wall 420 of the back plate 400 is slightly greater than the diameter of the annular shaped wall 220 to allow reception of the annular shaped wall 220 into the hollow interior within the annular shaped wall 420 of the back plate 400, thereby effectuating a friction fit between the mount 200 and the back plate 400.

It will also be appreciated that additional snap fit features can be added to the mount 200 and back plate 400. For example, the inner surface of the annular shaped wall 420 can include one snap fit element and the outer surface of the annular shaped wall 220 can include a complementary snap fit element. For example, one snap fit feature can be a male part (e.g., protrusion) and the other snap fit feature can be a complementary female element.

The engagement between the mount 200 and the back plate 400 allows for rotation of the framed article while the framed article is mounted to the support surface. More specifically, the outer frame element 300 can be grasped and rotated a desired number of degrees to reposition the framed article. Since the outer frame element 300 is attached to the back plate 400 which in turn is rotational coupled to fixed mount 200, the grasping and rotation of the outer frame element 300 results in the combined outer frame element 300 and back plate 400 rotating relative to the stationary mount 200.

Adjustable Framing System 500 (FIGS. 6-11)

In accordance with the present disclosure, as illustrated in FIGS. 6-11, a framing system or assembly (kit) 500, according to a second embodiment, is shown and described and is configured to create a framed article that can be displayed either on a support surface, such as a wall. The framed article is configured to display an image that is part of the image substrate 20 that is held and displayed within the framing system 100. The image substrate 20 is typically a rigid substrate on which an image is displayed.

Like the framing system 100, the framing system 500 is formed of a number of parts that engage one another to form the assembled framed article. In addition, as described herein, like the framing system 100, the framing system 500 is designed so that it can be rotational adjusted while being fixedly mounted to the support surface.

The framing system 500 has two main parts, namely, a mount 600 that is configured to be fixedly attached to the support surface and a frame subassembly that is formed of an outer frame element 700 and a back plate 800 that mates with the outer frame element 700 to form the assembled frame. As described herein, the outer frame element 700 and the back plate 800 are attached to one another with a mechanical fit and more particularly, can snap-fittingly mate with one another.

Mount 600

Like the mount 200, the mount 600 is constructed and intended to be fixedly attached to the support surface (wall), while allowing the frame subassembly to be rotatably coupled to the mount 600. As described herein, this arrangement allows for the frame subassembly to be adjusted, in a rotational direction, while the entire framed article is mounted to the support surface. In other words, the framed article does not have to be taken down in order to make (rotational) adjustments.

The mount 600 has a center wall 610 that has an inner surface 612 and an outer surface 614. In the illustrated embodiment, the mount 600 has a disk shape and therefore, the center wall 610 has a circular shape.

Along the inner surface 612, the mount 600 includes on the inner surface 612 a plurality of first coupling elements 615 that are spaced apart from one another and each has an arcuate shape.

As illustrated, the plurality of first coupling element 615 can be located along one half of the center wall 610. For example, there can be four first coupling elements 615 that are located along a first half of the center wall 610. Each of the first coupling elements 615 can be generally L-shaped with a first leg that is perpendicular to the center wall 610 and a second leg that extends outwardly from one end of the first leg. The first coupling elements 615 can have different arcuate lengths.

The outer surface 614 of the center wall 610 includes an adhesive pad (not shown), such as a double-sided adhesive pad that is bonded to the outer surface 614 along an inner surface thereof. The outer surface of the adhesive pad can include a release layer that is removed to reveal an adhesive layer, such as a permanent adhesive layer. The mount 600 is attached to the support surface by pressing the adhesive layer onto the support surface.

Spacer Tool 650

In accordance with one aspect of the present disclosure, the system 500 includes a spacer tool 650 that can be used to space one frame system 500 a prescribed distance from another frame system 500. It is very common for a series of framed articles to be mounted to the same support surface and set a uniform distance apart from one another. For example, when three framed articles are mounted together it is called a triptych. In order to properly mount such framed articles, precise measuring is required so that the spacing between adjacent framed articles is consistent. The spacer tool 650 and the construction of the inner surface 612 of the center wall 610 are specifically constructed to provide an easy, effective means for ensuring that the distance between the two framed articles is a user selected distance.

The spacer tool 650 is in the form of an elongated structure having a first end 652 and a second end 654. Each of the first end 652 and the second end 654 has a key appearance in that each end has a first set of protrusions 656 and a second set of protrusions 658, with the first set of protrusions 656 being at or closest to the respective end 652, 654.

The spacer tool 650 can also include a level, such as a bubble level, that is located along the spacer tool 650. As is known, a level, such as a bubble level is an instrument that is designed to indicate whether a surface is horizontal (level) or vertical (plumb). In this case, the level will indicate if the spacer tool 650 is horizontal or vertical.

The spacer tool 650 can be formed of any number of different materials, such as plastic. The outer surface of the center wall 610 has a complementary structure to receive the keyed end 652, 654 of the spacer tool 650 and more particularly, the outer surface of the center wall 610 includes a first recessed portion 630, a second recessed portion 631, a third recessed portion 632, and a fourth recessed portion 633 that are spaced apart 90 degrees from one another. The first recessed portion 630 can be positioned at the top (12 o'clock position), the second recessed portion 631 can be positioned to the right (3 o'clock position), the third recessed portion 632 can be positioned at the bottom (6 o'clock position) and the fourth recessed portion 633 can be positioned to the left (9 o'clock position) when the mount 600 is attached to the support surface (e.g., wall).

Each of the recessed portions 630, 631, 632, 633 is a negative of the key shaped end 652, 654 in that each of the recessed portions 630, 631, 632, 633 has a main recessed area 635 that mirrors the shaft of the spacer tool 650 and a series of recessed fingers 637 that extend outwardly from the spacer tool 650. In this illustrated embodiment, there are at least three sets of recessed fingers 637 which define a plurality of different engagement positions for the spacer tool 650. More specifically, to engage the spacer tool 650 to the mount 600, the key shaped end 652, 654 is laid into one locking position defined in one of the recessed portions 630, 631, 632, 633. For example, when mounting two framed articles side-by-side, the mount 600 of the framed article that is to be positioned on the right can be attached to the support surface using the adhesive layer of the mount 600 and such that the first recessed portion 630 occupies the 12 o'clock position. The keyed end 652 of the tool 650 is then placed into fourth recessed portion 633 of the mount 600 with the keyed end 652 occupying two sets of the recessed fingers 637 and similarly, the keyed end 654 of the tool 650 is placed into the second recessed portion 631 of the mount 600 that is for positioning of the left of the mount 600 that has been fixed to the support surface. The distance between the two framed articles is determined by the location of the keyed ends 652, 654 within the fourth recessed portion 633 and the second recessed portion 631, respectively. More particularly, it will be appreciated that if the inner most pair of recessed fingers 637 (those closer to the center of the mount 600) are used for both the fourth recessed portion 633 and the second recessed portion 631 then the two framed articles will be located a first distance apart. Conversely, if the outermost pair of recessed fingers 637 (those furthest from the center of the mount 600) are used for both the fourth recessed portion 633 and the second recessed portion 631 then the two framed articles will be located a second distance apart that is greater than the first distance. If the selected pairs of fingers 637 are intermediate ones, the distance between the two frames articles will be a third distance between the first and second distances.

Outer Frame Element 700

The outer frame element 700 is a hollow piece that has a main body that defines a hollow center opening 705. The outer frame element 700 can have any number of different shapes and sizes based on the intended shape and size of the framed article. The main body of the outer frame element 700 has a plurality of (e.g., four) interconnected walls 702, 704, 706, 708. The illustrated main body has a square shape and therefore, each of the interconnected walls 702, 704, 706, 708 can be in the form of a rail or the like. Each of the walls 702, 704, 706, 708 has an outer surface and an inner surface. The illustrated outer surface represents the portion of the frame system 100 that is readily visible and therefore, it can be smooth or it can have a decorative finish (and thus is not limited to being a smooth surface).

The outer frame element 700 can be formed of any number of suitable materials including suitable plastics (e.g., injection molded plastics).

The outer frame element 700 has first locking elements 715 to effectuate engagement and interlocking with the back plate 800 as described herein.

Back Plate 800

The back plate 800 serves as the rear part of the frame assembly 500 that is located behind the image substrate 20 and the engagement of the back plate 800 to the outer frame element 700 serves to capture and hold the image substrate 20 between the back plate 800 and the outer frame element 700.

As mentioned, the back plate 800 attaches to the outer frame element 700 and closes off the back of the frame system 500. As also described herein, the image substrate 20 is disposed and held between the back plate 800 and the outer frame element 700 and more particularly, the user places the image substrate onto an inner landing 710 of the outer frame element 700 and then attaches the back plate 800 to the outer frame element 700, thereby and the image substrate 20 therebetween.

As shown, the back plate 800 is inserted into the hollow opening of the outer frame element 700 with locking features of the back plate 800 engaging locking features of the outer frame element 700 to form a snap-fit. The back plate 800 has a complementary shape to the outer frame element 3700 and therefore, in the illustrated embodiment, the back plate 800 is square shaped.

As shown, the back plate 800 has a first wall 802, a second wall 804, a third wall 806, and a fourth wall 808 that are all interconnected to one another. Between the first wall 802, the second wall 804, the third wall 806, and the fourth wall 808, an inner wall 810 is provided and extends between these walls. The inner wall 810 has a front face that faces and contacts the image substrate.

Within the hollow center of the back plate 800, there is a center wall 820 that in the illustrated embodiment has a circular shape and is connected to the walls 802, 804, 806, 808. For example, the annular shaped wall 820 can be connected to each side wall 802, 804, 806, 808 by a connecting wall or spoke 829. In the illustrated embodiment, the center wall 820 has four spokes 829 that connect to the side walls 802, 804, 806, 808.

The back plate has second locking elements 815 to effectuate engagement and interlocking with the first locking elements 715 of the outer frame element 700.

Along the outer surface of the center wall 820 that faces away from the outer frame element 700, there are a plurality of second coupling elements 825 that are configured to engage the first coupling elements 615 so as to couple the back plate 800 to the mount 600 in such that that the back plate 800 (and framed article) can rotate relative to the mount 600 that is fixedly attached to the support surface (wall). The second coupling elements 825 are complementary to the first coupling elements 615 so that when the first and second coupling elements 615, 825 mate together, the back plate 800 and mount 600 are attached to one another. As shown, the second coupling elements 825 are circumferentially spaced about the outer (rear) face of the center wall of the back plate 800. As shown, the second coupling elements 825 are formed along a circle unlike the first coupling elements 615 that are only formed in a semi-circular pattern. There are a greater number of second coupling elements 825 than the first coupling elements 615.

Each second coupling element 825 can have an L-shape with a first leg that is perpendicular to the center wall 820 and a second leg that extends outwardly from one end of the first leg. The second coupling elements 825 can have different arcuate lengths or as shown, they can have the same arcuate lengths and can be uniformly spaced in the circular pattern.

The back plate 800 can be formed of any number of suitable materials including suitable plastics (e.g., injection molded plastics). As shown, the back plate 800 is preferably an integral single piece structure.

Mounting Process

The manner in which the mount 600 engages and interlocks with the back plate 800 by means of the first and second coupling elements 615, 825 can be similar to how a French cleat operates. Since the second coupling element 825 are formed in a complete circular pattern, the assembled frame article can be oriented in multiple orientations, such as the first wall 802 can be the top wall, it can be a right wall, a bottom wall or a left wall of the framed article when it is mounted to the support surface using the mount 600.

Figure 11:
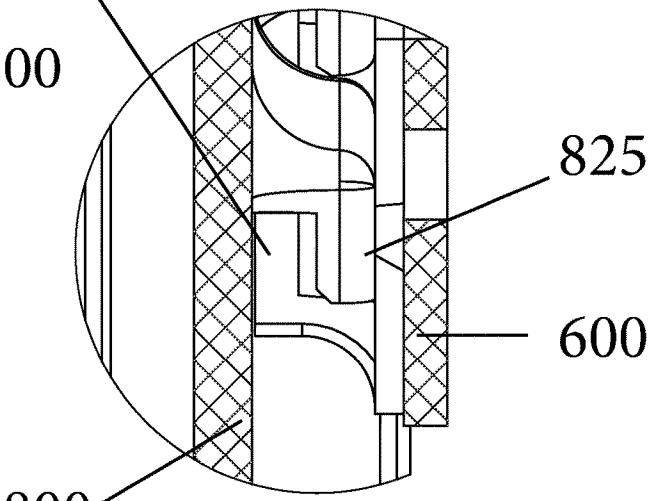
FIG. 11 is an enlarged closeup of a portion of FIG. 10.
Figure 10:
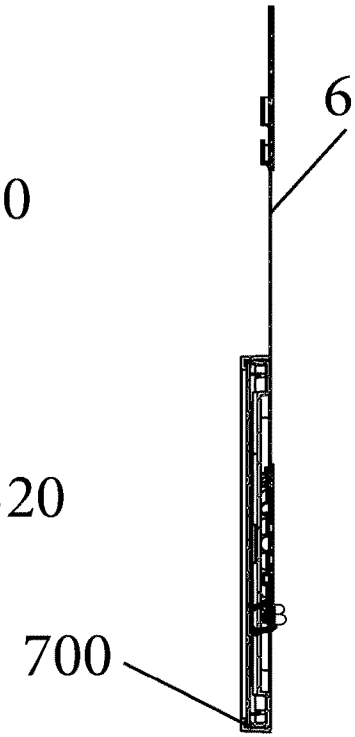
FIG. 10 is a cross-sectional view taken through the line A-A of FIG. 9.
Figure 9:
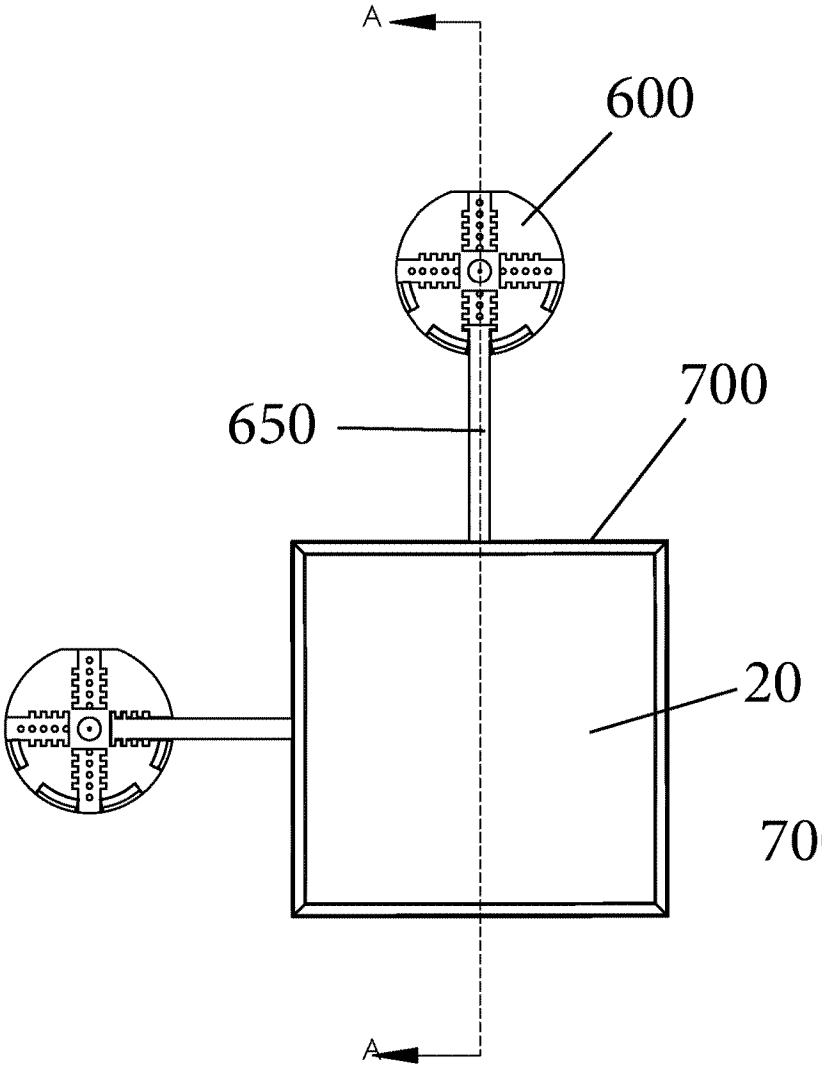
FIG. 9 is a front elevation view of one adjustable framing system with a spacer tool being used to position two additional mounts on the support surface.

Thus, regardless of the orientation of the frame article, the back plate 800 is attached to the mount 600 by first locating the frame subassembly (700, 20, 800) above the center of the mount 600. In this position, the frame subassembly is then dropped downward until a selected number (i.e., a subset) of the second coupling elements 825 engage and interlock with all of the first coupling elements 615. In other words, the second coupling elements 825 slide into engagement with the first coupling elements 615 as shown in FIG. 11. It will be appreciated that a majority of the second coupling elements 825 do not engage corresponding first coupling elements 615; however, the engagement of the four second coupling elements 825 with four corresponding first coupling elements 615 that are oriented in the lower half of the mount 600 provides a secure attachment.

This engagement thus securely attaches the frame subassembly (outer front element 700 and the back plate 800) to the mount 600 that is fixed to the support surface (wall); however, the frame subassembly (700, 20, 800) can freely rotate relative to and about the fixed mount 600 without having to remove any of the parts from the support surface. When the frame subassembly is rotated, other second coupling elements 825 that were not initially engaged with the first coupling elements 615 now rotate into engagement with the fixed first coupling elements 615.

It is to be understood that like numerals in the drawings represent like elements through the several figures, and that not all components and/or steps described and illustrated with reference to the figures are required for all embodiments or arrangements.

Figure 6:
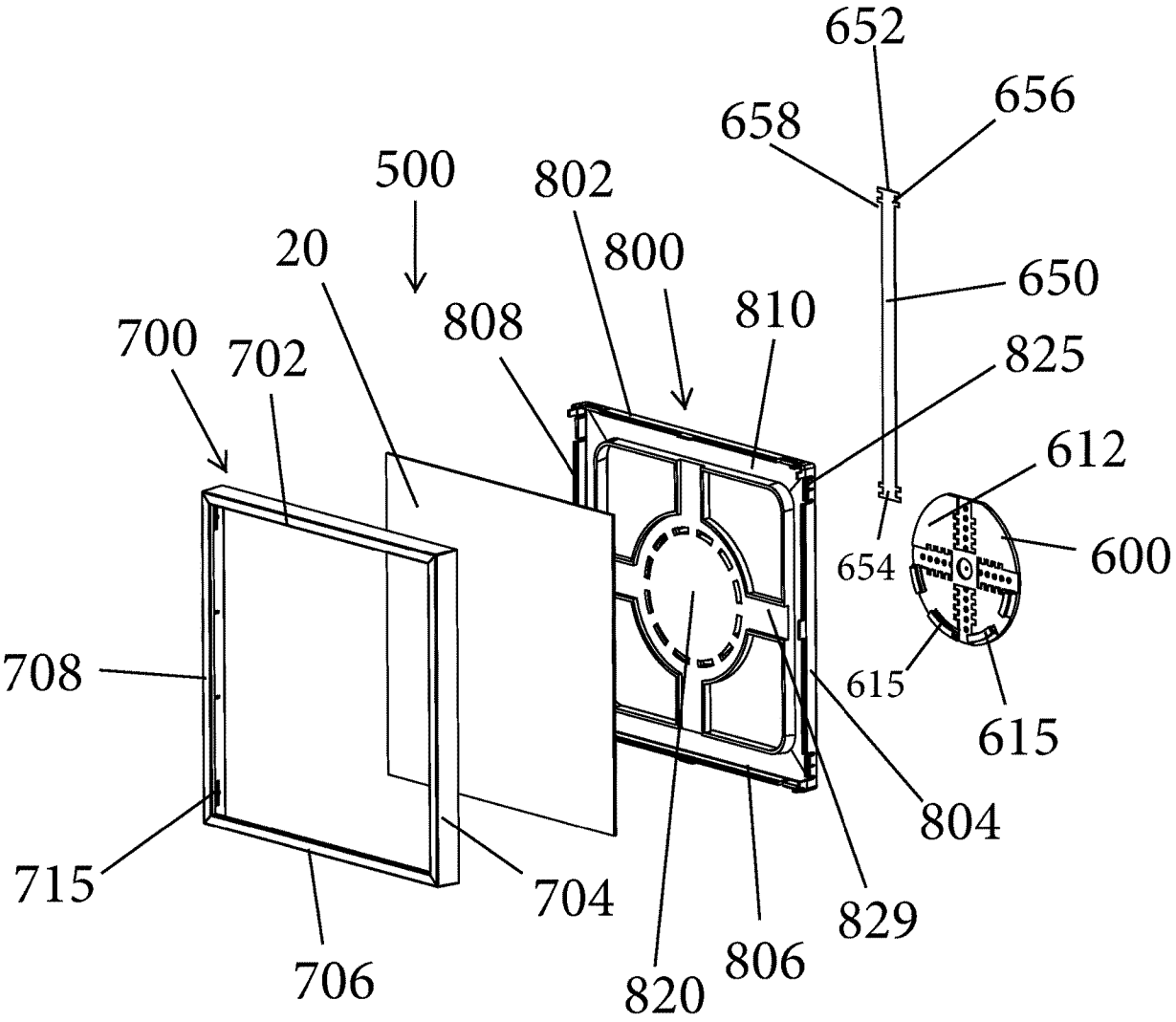
FIG. 6 is an exploded perspective view of an adjustable framing system according to a second embodiment.
Figure 8:
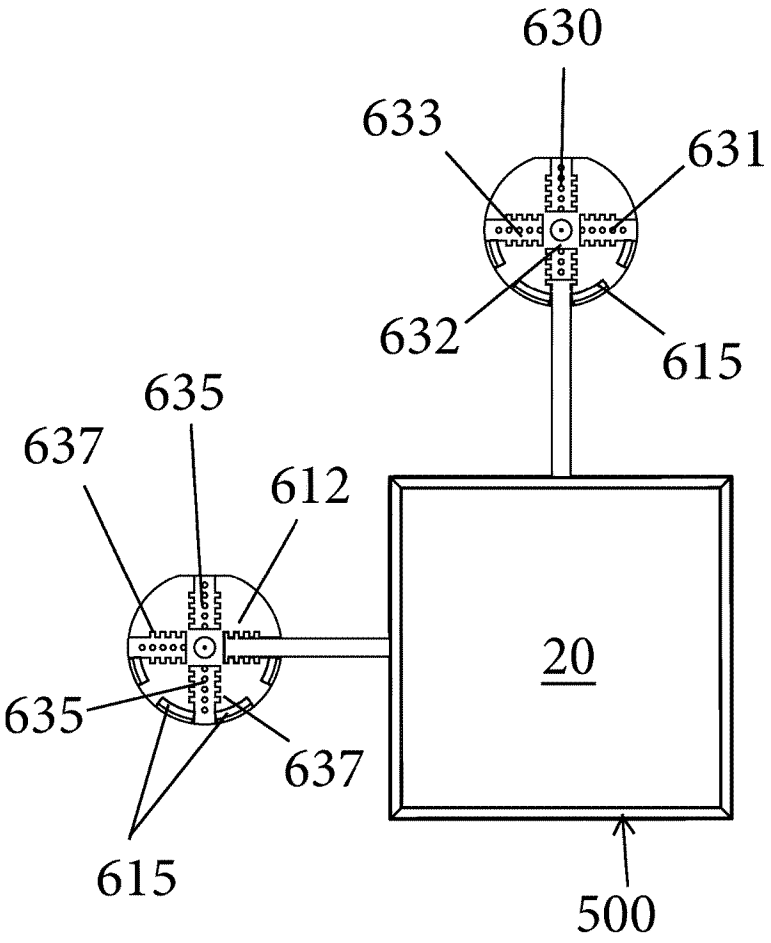
FIG. 8 is a front elevation view of the plurality of adjustable framing systems arranged in spaced relationship on the support surface.
Figure 7:
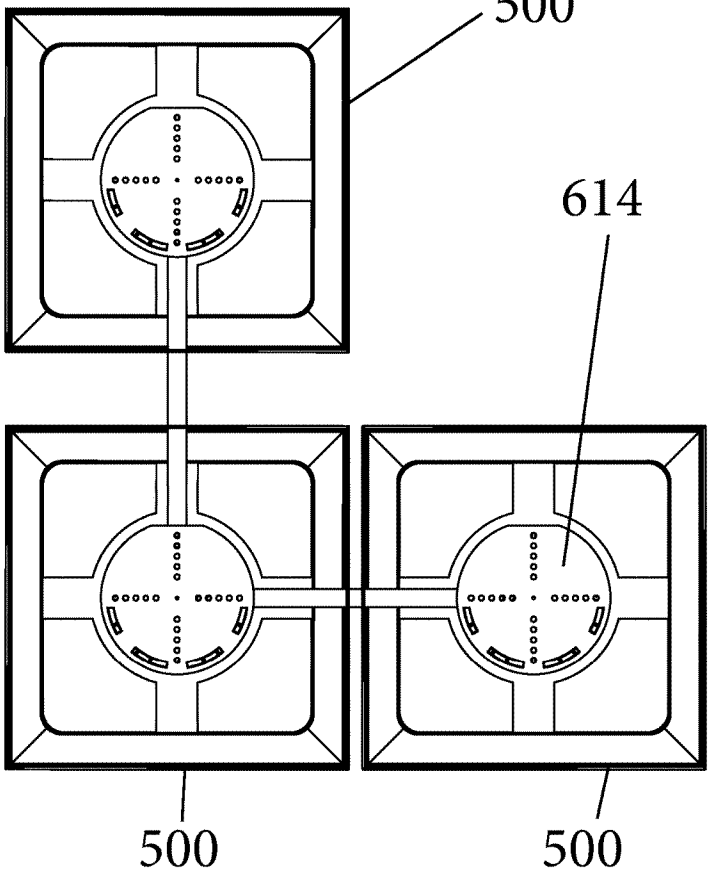
FIG. 7 is a rear elevation view of a plurality of adjustable framing systems that are arranged in spaced relationship on a support surface.

As shown in FIG. 6, in the center of the center wall of the mount 600, there can be a pin hole in which a thumb tack can be passes through in the event that mount 600 needs to be attached to the support surface using additional means.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not precludes the presence or addition of one or more other features, integers, steps, operations, elements, components, and/or groups thereof.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

The subject matter described above is provided by way of illustration only and should not be construed as limiting. Various modifications and changes can be made to the subject matter described herein without following the example embodiments and applications illustrated and described, and without departing from the true spirit and scope of the present invention, which is set forth in the following claims.

What is claimed is:

1. A frame system comprising:

a mount having an outer surface for receiving an adhesive for placement on a support surface and an inner surface that includes a plurality of first coupling elements;

a hollow outer frame element;

a back plate configured for insertion into and snap-fit attachment to the outer frame element, wherein the back plate includes a plurality of second coupling elements that snap-fittingly mate with the first coupling elements for attaching the back plate to the mount in such a way that the back plate can rotate relative to the mount to allow for rotational adjustment of the combined outer frame element and the back plate;

wherein the back plate comprises a circular shaped body that projects rearward, the circular shaped body being centrally located and being connected to side walls of the back plate by a plurality of spokes, with open spaces being formed between adjacent spokes.

2. A frame system comprising:

a mount having an outer surface for receiving an adhesive for placement on a support surface and an inner surface that includes a plurality of first coupling elements;

a hollow outer frame element;

a back plate configured for insertion into and snap-fit attachment to the outer frame element, wherein the back plate includes a plurality of second coupling elements that snap-fittingly mate with the first coupling elements for attaching the back plate to the mount in such a way that the back plate can rotate relative to the mount to allow for rotational adjustment of the combined outer frame element and the back plate;

wherein the mount is disk shaped and the second coupling elements comprises a plurality of L-shaped protrusions that engage a plurality of L-shaped protrusions that comprise the first coupling elements.

3. The frame system of claim 2, wherein the outer frame element and back plate are attached with a snap-fit.

4. The frame system of claim 2, wherein the first coupling elements are all located within a bottom half of the mount and there is a greater number of second coupling elements relative to the number of first coupling elements.

5. The frame system of claim 4, wherein the first coupling elements are formed in a semi-circular pattern and are spaced apart from one another and each has an arcuate shape, while the second coupling elements are formed in a complete circular pattern and are spaced apart from one another and each has an arcuate shape.

6. The frame system of claim 2, wherein the inner surface of the mount has a plurality of recessed areas, each recessed area having a key shape and the frame system further includes a spacer tool having first and second ends that each has a key shape that mirrors the key shape of the recessed areas to allow insertion and mating of the respective end of the spacer tool within one of the recessed areas.

7. The frame system of claim 6, wherein the key shape of each recessed area defines multiple reception positions for the key shaped first or second end of the spacer tool.

8. The frame system of claim 6, wherein the plurality of recessed comprises four recessed areas that are located 90 degrees apart from one another.

9. The frame system of claim 6, wherein one of the plurality recessed area is located between a pair of first coupling elements.

10. The framer system of claim 2, wherein the back plate includes a circular center section, the second coupling elements being formed on the circular center section.

11. A frame system comprising:

a mount having an outer surface for receiving an adhesive for placement on a support surface;

a hollow outer frame element for receiving a substrate to be displayed;

a back plate configured for insertion into and snap-fit attachment to the outer frame element and configured for securely holding the substrate in place between the outer frame element and the back plate, wherein the back plate is snap-fittingly attached to the mount in such a way that the back plate can rotate relative to the mount to allow for rotational adjustment of the combined outer frame element and the back plate;

wherein the back plate comprises a circular body with an inwardly extending lip that defines an underside space, wherein an outwardly extending lip at a free end of an annular shaped wall of the mount mates with the inwardly extending lip to effectuate the snap-fit attachment between the mount and the back plate.

12. The frame system of claim 11, wherein the circular body is centrally located and is connected to side walls of the back plate by a plurality of spokes, with open spaces being formed between adjacent spokes.

13. A frame system comprising:

a mount having an outer surface for receiving an adhesive for placement on a support surface;

a hollow outer frame element for receiving a substrate to be displayed;

a back plate configured for insertion into and snap-fit attachment to the outer frame element and configured for securely holding the substrate in place between the outer frame element and the back plate, wherein the back plate is snap-fittingly attached to the mount in such a way that the back plate can rotate relative to the mount to allow for rotational adjustment of the combined outer frame element and the back plate;

wherein the mount includes an inner surface that has a plurality of recessed areas, each recessed area having a first profile and the frame system further includes a spacer tool having first and second ends that each has a key shape that mirrors the first profile of the recessed areas to allow insertion and mating of the respective end of the spacer tool within one of the recessed areas.

14. The frame system of claim 13, wherein the profile of each recessed area defines multiple reception positions for the key shaped first or second end of the spacer tool.

15. The frame system of claim 13, wherein there are four recessed areas that are located 90 degrees apart from one another.

16. The frame system of claim 13, wherein one of the plurality recessed area is located between a pair of first coupling elements that are part of a plurality of first coupling elements that are part of the mount and snap-fittingly attach to a plurality of second coupling element that are located along a rear of the back plate.

17. The frame system of claim 16, wherein the mount is disk shaped and the plurality of first coupling elements comprises a plurality of L-shaped protrusions that engage a plurality of L-shaped protrusions that comprise the plurality of second coupling elements.

18. The frame system of claim 16, wherein the plurality of first coupling elements are all located within one half of the mount and there is a greater number of second coupling elements relative to the number of first coupling elements.

* * * * *